US005993309A

United States Patent [19]

Howell et al.

[11] Patent Number: 5,993,309

[45] Date of Patent: Nov. 30, 1999

[54] CHIMNEY FAN

[76] Inventors: Chris Howell, 1524 Orchid Ct., Flower Mound, Tex. 75028; Michael A. Scofield, 5717 Treese St., The Colony, Tex. 75056

[21] Appl. No.: 09/087,704

[22] Filed: Jun. 1, 1998

[51] Int. Cl.[6] ..... F23L 17/02

[52] U.S. Cl. ..... 454/16; 454/17; 454/22

[58] Field of Search ..... 454/16, 17, 22, 454/23

[56] References Cited

U.S. PATENT DOCUMENTS

| | | | |
|---|---|---|---|
| 898,730 | 9/1908 | Davidson | 454/22 |
| 1,582,373 | 4/1926 | Beck | 454/17 |
| 1,920,918 | 8/1933 | Stainhofer | 454/23 |
| 3,841,208 | 10/1974 | Knox . | |
| 4,236,443 | 12/1980 | Schossow . | |
| 4,342,258 | 8/1982 | Zaniewski . | |
| 5,566,667 | 10/1996 | Cox | 126/507 |
| 5,609,522 | 3/1997 | Szwartz | 454/7 |

FOREIGN PATENT DOCUMENTS

| | | | |
|---|---|---|---|
| 1048 | 4/1869 | United Kingdom | 454/22 |
| 13397 | 10/1884 | United Kingdom | 454/22 |
| 3299 | 1/1893 | United Kingdom | 454/22 |
| 6022 | 1/1904 | United Kingdom | 454/22 |

OTHER PUBLICATIONS

Unknown publication "Safety and Trouble Shooting", p. 107.

Unknown publication "Building a Brick Fireplace", p. 71.

Unknown publication "Components", pp. 33–34.

Unknown publication "Heating with Wood Stoves", p. 204.

Unknown publication "Fireplaces", p. 84.

Unknown publication "Building a Stone Fireplace", p. 61.

*Primary Examiner*—Harold Joyce

*Attorney, Agent, or Firm*—Kristin Jordan Harkins

[57] ABSTRACT

A chimney exhaust system for facilitating or creating an upward draft in a chimney flue, operating on what is referred to as "Bernoulli's Principle" comprises a housing unit having a tubular cross member and a tubular depending member, both members having an inlet and an outlet. The outlet of the depending member intersects the cross member at an intermediate position between the inlet and outlet of the cross member. The depending member is mounted to a chimney flue at its inlet and acts as an extension thereof. A fan is attached to the housing unit proximate the cross member to generate air flow through the cross member and across the opening of the depending member's outlet. The air flow generated through the cross member creates an upward draft of the air in the chimney flue and the depending member.

8 Claims, 3 Drawing Sheets

CHIMNEY FAN

FIELD OF THE INVENTION

The present invention relates to a chimney exhaust system for creating or increasing the upward draw in a chimney flue, thereby facilitating burning conditions in a fireplace and preventing smoke or unburned gas from entering a room, while also preventing leaves, dirt, animals, wind and other foreign objects from entering the flue.

BACKGROUND OF THE INVENTION

Chimneys which facilitate or create an upward draft or draw produce optimal burning conditions in a fireplace. In addition, an upward draft in chimneys prevents smoke or unburned gas, in wood burning or gas fireplaces, respectively, from entering a room. In a conventional chimney, an upward draft is facilitated or created by the flow of outside air in breezy or windy conditions which draws air up from the fireplace through the chimney flue.

However, many chimneys do not facilitate or create an upward draft or draw for a number of reasons. For example, a chimney which is constructed too low to catch a breeze that is needed to help pull air upward from the fireplace through the flue will not draw properly. On the other hand, chimneys which are too tall do not draw properly since the distance from the fireplace to the chimney flue top may impede the amount of air flow necessary for an upward draft.

Another example of a structural problem which may obstruct the upward draft or draw through a chimney includes an incorrectly sized fireplace or opening between the fireplace and the flue which may prevent or restrict the upward draft. Further, dwellings with insufficiently moving air or no built-in outside air duct in the fireplace will prevent a chimney from drawing properly.

An improperly drawn chimney may also be caused by objects which obstruct the normal flow of outside air, for example a tree limb or a nearby dwelling or hill that is too close to the chimney. Not only do structural problems or objects which obstruct the normal flow of outside air prevent or limit the draw, the problems are exasperated since many times a downdraft of outside air into the chimney is created. Downdrafts contribute to improper burning conditions in the fireplace, as well as blowing smoke or unspent gas into the room.

Patents which disclose fireplace ventilation systems include U.S. Pat. No. 5,609,522 to Szwartz where a combination damper and chimney cap apparatus is installed at the top of the chimney to ventilate a fireplace by providing a draft through the flue. The apparatus includes a platform mounted to the flue which has an aperture for communication with the flue. An element provided in the platform senses temperature and smoke in the flue and at an area external to a fireplace and provides a signal in response to the temperature or smoke. A ventilation fan is connected to the platform to provide a draft sufficient to exhaust the smoke from the fireplace and flue and to cool an electronic motor which drives the apparatus.

U.S. Pat. No. 5,566,667 to Cox discloses a filter and fan assembly for filtering dust and smoke out of hot exhaust gases from a wood burning fireplace. The assembly includes a filter element positioned directly above the flue opening. A fan is located directly above the filter element to ensure that exhaust gases are actively drawn up through the filter.

A chimney stack exhaust treatment unit is disclosed in U.S. Pat. No. 4,236,443 to Schossow. The unit comprises a spherical outer housing which fits over the flue opening and encloses a horizontally mounted fan. The fan is directly over the flue opening so that when it rotates, exhaust gases are drawn up through the chimney and swirled around the inner walls of the outer housing. Exhaust ports near the top of the housing provide an exit for treated gas.

In accordance with the present invention, there is provided a chimney exhaust system which operates on what is referred to as "Bernoulli's Principle." The principle can be simplistically explained in terms of pressure and velocity of air. According to Bernoulli's Principle, energy in an air system, which is a function of pressure and velocity, is constant. Accordingly, an air stream having a higher velocity necessarily has a lower pressure than an air stream in the same system which has a lower velocity. Applying Bernoulli's Principle to the operation of a chimney flue, the velocity of the moving air stream across the opening of the chimney flue creates a lower pressure area at the flue opening. Conversely, since the air in the flue is substantially stagnate, its pressure is necessarily higher than the pressure of the moving air stream across the flue opening. The high pressure air in the flue is drawn to the lower pressure area at the opening of the flue created by the moving air stream. The moving air stream has thus created the draw or upward draft necessary to pull the air up from the fireplace through the chimney flue.

SUMMARY OF THE INVENTION

In accordance with the present invention, there is provided a chimney exhaust system for facilitating or creating a draft or upward draw in a chimney flue. The system used in the present invention comprises a housing unit having a tubular cross member and a tubular depending member, both members having an inlet and an outlet. The outlet of the depending member intersects the cross member at an intermediate position between the inlet and the outlet of the cross member to form substantially a T pipe.

The housing unit is mounted to a chimney flue at the inlet of the depending member or lower portion of the T pipe by a connector or collar. The connector creates a seal between the inlet of the depending member and the chimney flue such that no appreciable amount of air escapes from the flue to the atmosphere without passing through the housing unit. In its mounted position, the depending member of the housing unit functions as an extension of the chimney flue for air to flow from the flue into the cross member of the housing unit.

A fan is attached to the housing unit proximate its cross member to generate air flow through the cross member and across the opening of the depending member. The air flow generated by the fan through the cross member of the housing unit creates a draft or upward draw of the air in the chimney flue and the depending member into the air flow generated in the cross member. This draft or upward draw facilitates burning conditions in a fireplace and prevents smoke or unburned gas from entering a room, while also preventing leaves, dirt, animals, wind and other foreign objects from entering the flue.

In a preferred embodiment of the present invention, the fan is a positive displacement fan located at the inlet of the cross member for generating an air flow stream through the cross member and its outlet into the atmosphere.

In another embodiment of the present invention, a barrier member is positioned within the housing unit to partially cover the outlet of the depending member. Thus the air flow generated by the fan would contact the air in the chimney flue at some intermediate location of the outlet of the depending member. In an alternative embodiment, the barrier member is a plate. In a further alternative embodiment, the barrier member is a tubular inner member mounted coaxially within the cross member of the housing unit. In combination with a positive displacement fan, the inner member extends through the cross member from its inlet and terminates at an intermediate location at the outlet of the depending member. The fan is mounted in the tubular inner member at the inlet of the cross member. Accordingly, the air flow generated by the fan would contact the air in the chimney flue proximate the termination location of the inner member at the outlet of the depending member.

In a further embodiment of the present invention, the connector or collar is adapted to rotatably mount the housing unit to the chimney flue. The housing unit rotates or swivels in the prevailing wind for alignment of the cross member longitudinally in the direction of the wind flow. The wind flow through the cross member of the present invention effectively generates air flow through the cross member for creating or increasing the upward draft of air through the chimney flue. A weather vane can be attached to the cross member longitudinally for facilitating the wind direction alignment of the cross member.

The fan can be operated by a wall switch mounted inside the dwelling proximate the fireplace. The switch could be of the reostat type to vary the speed of the fan depending on the prevailing wind conditions.

Screens can be attached to the housing unit at the inlet and outlet of the cross member to aid in preventing foreign objects from entering the flue, as well as arresting sparks that may escape from the fireplace through the flue.

BRIEF DESCRIPTION OF THE DRAWINGS

For a more complete understanding of the present invention, and for further details and advantages thereof, reference is now made to the following Detailed Description taken in conjunction with the accompanying drawings, in which.

DETAILED DESCRIPTION OF THE INVENTION

Figure 1:
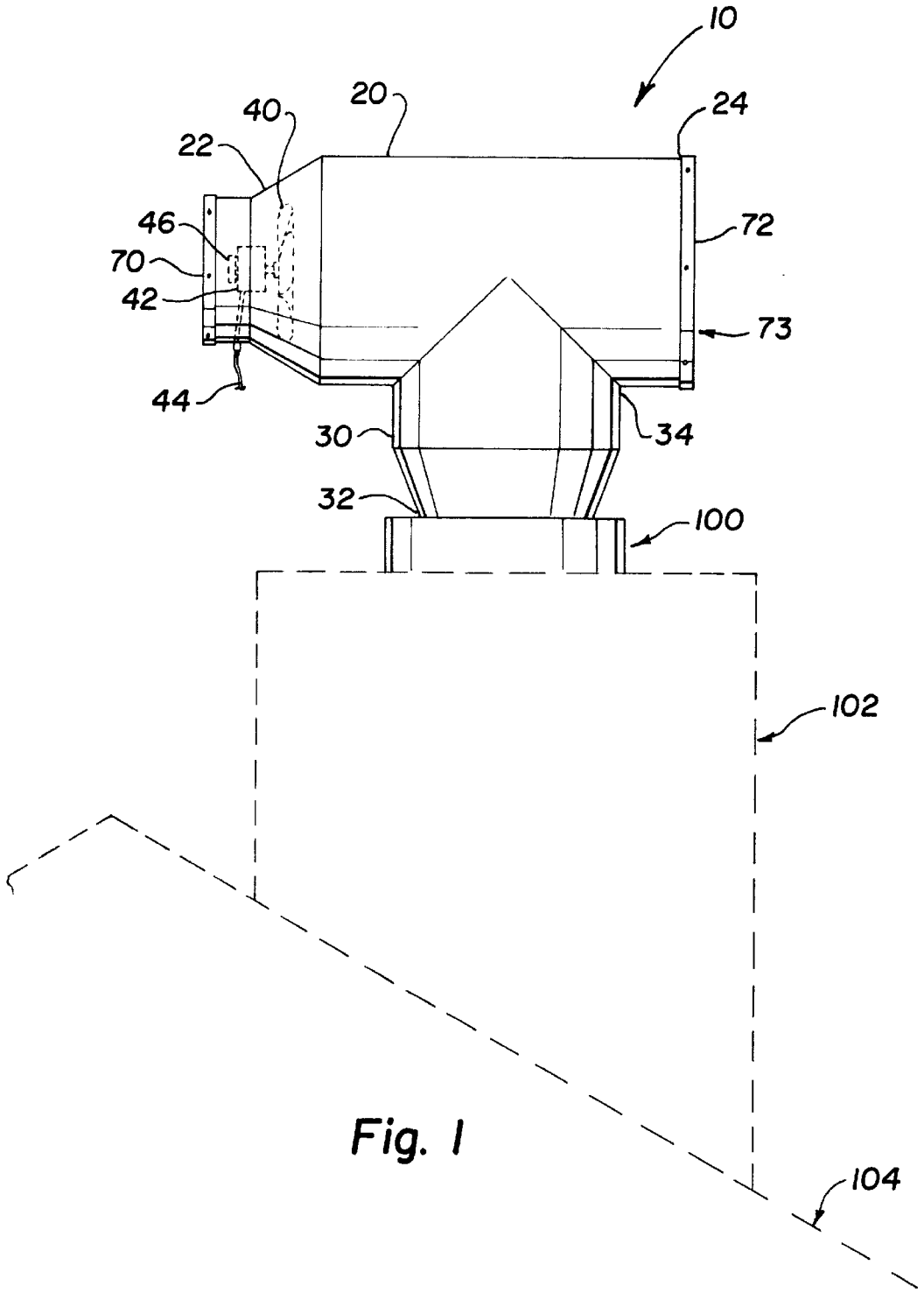
FIG. 1 provides a perspective sectional view of a chimney exhaust system connected to a chimney flue shown in phantom in combination with a chimney and roof of a dwelling.

REFERRING TO FIG. 1, a chimney exhaust system is mounted on a chimney flue 100 provided in chimney 102 positioned on roof 104. The chimney exhaust system includes a housing unit 10 having a tubular cross member 20 and a tubular depending member 30. The cross member 20 and the depending member 30 both include an inlet 22 and 32, respectively, and an outlet 24 and 34, respectively. The depending member 30 is attached to the cross member 20 at its outlet 34 at an intermediate position between the inlet 22 and the outlet 24 of the cross member 20. Preferably, the depending member 30 and the cross member 20 form substantially a T pipe, although it is to be understood by one skilled in the art that other configurations are suitable.

The housing unit 10 is mounted to a chimney flue 100 at the inlet 32 of the depending member 30. The depending member 30 and the chimney flue 100 are attached using a connector (not shown). The connector creates a seal between the inlet 32 of the depending member 30 and the flue 100 such that no appreciable amount of air escapes therebetween. In its mounted position, the depending member 30 of the housing unit 10 functions as an extension of the chimney flue 100 for air flowing from the flue 100 and depending member 30 into the cross member 20 of the housing unit 10.

Figure 2:
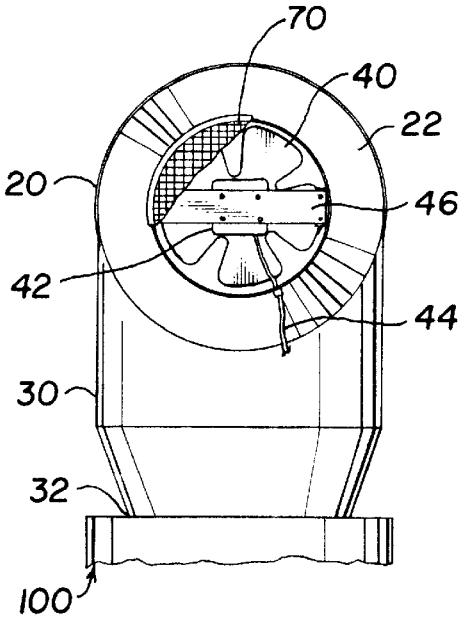
FIG. 2 provides a side view of a chimney exhaust system from an inlet of a tubular cross member of a housing unit.
Figure 3:
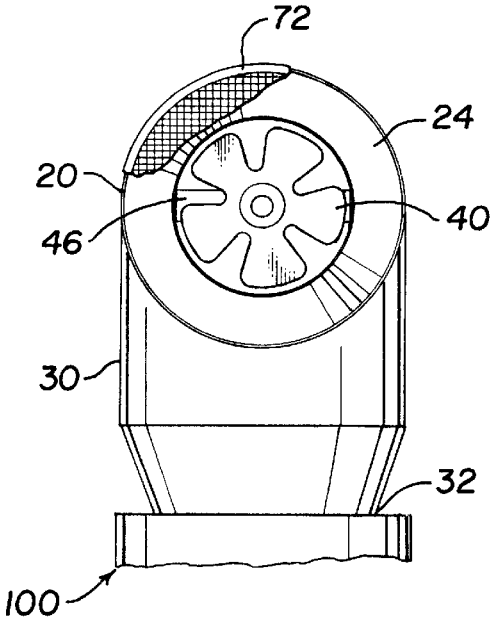
FIG. 3 provides a side view of a chimney exhaust system from an outlet of the tubular cross member of the housing unit.

REFERRING TO FIGS. 1, 2 and 3, a fan 40 is positioned in the housing unit 10 for generating air flow through the cross member 20. Desirably, the fan 20 is a positive displacement fan located proximate the inlet 22 of the cross member 20. However, it is to be understood by one skilled in the art that an exhaust fan (not shown) could be located at the outlet 24 of the cross member 20 for drawing air through the cross member 20. The fan 40 can be affixed to a bar 46 attached to the housing unit 10 at the inlet 22 of the cross member 20. However, it is to be understood by one skilled in the art that other means for affixing the fan 40 to the housing unit 10 are suitable. The fan 40 driven by a motor 42 or other prime movers generates air flow through the cross member 20 from its inlet 22 through its outlet 24 into the atmosphere. The motor 42 can be electrically powered utilizing wire 44 connected to a wall switch inside a dwelling proximate a fireplace. It will be recognized that alternative power sources for driving the fan 40 are suitable.

In operation, the fan 40 generates air flow through the cross member 20 of the housing unit 10 from the inlet 22 to the outlet 24 and into the atmosphere. The air flow through the cross member 20 is at a higher velocity and accordingly, a lower pressure than the substantially stagnant air in the depending member 30 and the chimney flue 100. The higher pressure air in the depending member 30 and chimney flue 100 is pulled upward through the outlet 34 of the depending member 30 into the air flow moving through the cross member 20 and its outlet 24. The draft or upward draw of the air in the flue 100 created by the fan 40 generating air flow through the cross member 20 flow facilitates burning conditions in the fireplace. The generated air flow creates the draw necessary to ignite wood burning fires without filling the room with smoke in poor drawing chimney flues and prevents unspent gas from gas fireplaces from filling the room. The generated air flow also prevents downdrafts from entering the chimney flue and causing sparks and ashes to enter the dwelling. Additionally, leaves, dirt, animals, wind and other foreign objects are precluded from entering the flue 100.

Figure 4:
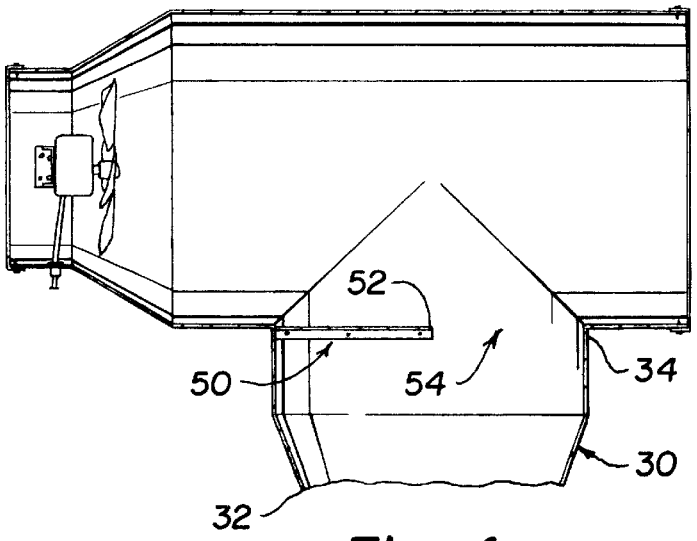
FIG. 4 provides a perspective sectional view of an alternative embodiment of a chimney exhaust system.

REFERRING TO FIG. 4, an alternative embodiment of the present invention includes a plate 50 positioned within the housing unit 10 acts as a barrier member to partially cover the outlet 34 of the depending member 30 proximate the inlet 22 of the cross member 20. The plate 50 terminates at an intermediate location 52 in the outlet 34 of the depending member 30. Thus the draw created from the air generated by fan 40 through the cross member 20 results proximate the area of opening 64 of the outlet 34 of the depending member 30. Preferably, the plate 50 terminates at location 52 to cover in the range of one quarter to three quarters of the outlet 34 of the depending member 30. More preferably, the plate 50 terminates at location 52 to cover in the range of one third to three thirds of the outlet 34 of the depending member 30. Even more preferably, the plate 50 terminates at location 52 which is approximately at the midpoint of the outlet 34 of the depending member 30. In each instance, the draw generated by the air forced by fan 40 through the cross member 20 occurs in the area of opening 54 of the outlet 34 of the depending member 30.

Figure 5:
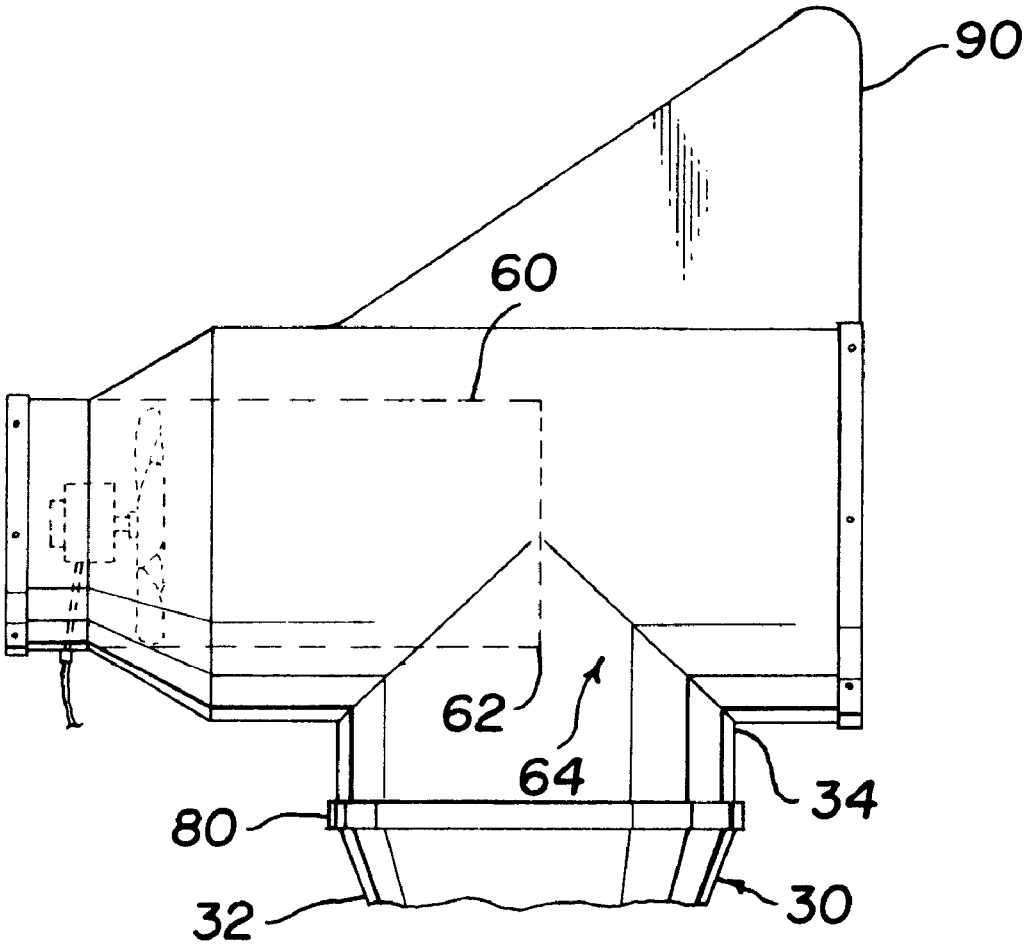
FIG. 5 provides a perspective sectional view of another embodiment of a chimney exhaust system.

REFERRING TO FIG. 5, another alternative embodiment of a barrier member is a tubular inner member 60 mounted within housing unit 10 at inlet 22 of cross member 20. The inner member 60 extends through cross member 20 from inlet 22 and terminates at intermediate location 52. The fan 40 is mounted inside tubular inner member 60 proximate inlet 22 of cross member 20 for generating air flow through tubular inner member 60 into cross member 20 and through outlet 24. The inner member 60 partially covers outlet 34 of the depending member 30 proximate inlet 22 of the cross member 20. Thus the draw created from the air generated by fan 40 through tubular inner member 60 is proximate the area of opening 64 of outlet 34 of the depending member 30. Preferably, the tubular inner member 60 terminates at location 62 to create opening 64 which is in the range of one quarter to three quarters of the outlet 34 of the depending member 30. More preferably, the tubular inner member 60 terminates at location 62 to create opening 64 which is in the range of one third to three thirds of the outlet 34 of the depending member 30. Even more preferably, the tubular inner member 60 terminates at location 62 which is proximate the midpoint of the outlet 34 of the depending member 30. In each instance, the draw generated by the air forced by fan 40 through the tubular inner member 60 into cross member 20 occurs in the area of the opening 64 of outlet 34 of depending member 30.

A further alternate embodiment of the present invention includes a swivel connector 80 adapted to rotatably mount the housing unit 10 to a chimney flue 100. It is to be understood by one skilled in the art that other means for rotatably mounting the housing unit 10 to a chimney flue 100 are suitable. The housing unit 10 rotates or swivels in the prevailing wind for alignment of the cross member 20 longitudinally in the direction of the wind flow. The wind flow through the cross member 20 of the present invention effectively generates air flow through the cross member 20 for creating or increasing the upward draft of air through the chimney flue 100. A weather vane 90 having a head 92 and a tail 94 can be positioned longitudinally on the upper side of the cross member 20. The tail 94 is proximate the outlet 24 of the cross member 20 for alignment of the cross member 20 longitudinally in the direction of the wind flow. The wind entering the cross member 20 through its inlet 22 facilitates the generation of air flow through the cross member 20 for creating a draft or upward draw of the air in the chimney 102.

In an alternative embodiment, stops (not shown) can be positioned within the swivel connector 80 to prevent the housing unit 10 from rotating freely about the flue 100. Preferably, the stops are positioned to allow the housing unit 10 to swivel approximately 180 degrees.

Screens 70, 72 can be attached to the housing unit 10 at the inlet 22 and outlet 24, respectively, of cross member 20 for preventing foreign objects from entering the chimney flue 100. Additionally, screens 70, 72 function as spark arrestors in the event that sparks escape from the fireplace into the flue 100 and through the housing unit 10.

The screen 72 located at the outlet 24 of the cross member 20, can be designed to counterbalance the weight of the fan 40 located at the cross member inlet 22. Preferably, the counterbalance effect can be accomplished by constructing the screen 72 from a relatively heavy material. However, it is to be understood by one skilled in the art that other embodiments to counterbalance the weight of the fan 40 are suitable. One such alternative embodiment is the addition of a counterbalance collar 73 located at the outlet 24 of the cross member 20.

We claim:

1. A chimney exhaust system comprising:

a housing unit having a tubular cross member and a tubular depending member, said cross member and said depending member each having an inlet and an outlet, said outlet of said depending member intersecting said cross member at an intermediate position between said inlet and said outlet of said cross member;

a connector adapted to mount said housing unit to a chimney flue proximate said inlet of said depending member; and, a positive displacement fan mounted in said cross member proximate said inlet of said cross member to generate an air stream through said cross member and across said outlet of said depending member, said fan creating an upward pull of air from the chimney flue through said depending member into the generated air stream moving through said cross member.

2. A chimney exhaust system, as recited in claim 1, further comprising:

a barrier member provided in said housing unit, said barrier member extending across said outlet of said depending member and terminating at an intermediate location therein.

3. A chimney exhaust system, as recited in claim 2, wherein said barrier member terminates proximate midpoint of said depending member outlet.

4. A chimney exhaust system, as recited in claim 2, wherein said barrier member is a transverse plate across said outlet of said depending member and terminating at an intermediate location therein.

5. A chimney exhaust system, as recited in claim 4, wherein said transverse plate terminates proximate midpoint of said depending member outlet.

6. A chimney exhaust system, as recited in claim 1, further comprising a weather vane positioned on said cross member of said housing unit for aligning said cross member longitudinally with a prevailing wind.

7. A chimney exhaust system, as recited in claim 6, further comprising:

a barrier member provided in said housing unit, said barrier member extending across said outlet of said depending member and terminating at an intermediate location therein.

8. A chimney exhaust system, as recited in claim 7, wherein said barrier member is a transverse plate across said outlet of said depending member and terminating at an intermediate location therein.

* * * * *